US012059048B2

(12) United States Patent
Teetzel et al.

(10) Patent No.: US 12,059,048 B2
(45) Date of Patent: Aug. 13, 2024

(54) HEADGEAR SHROUD ASSEMBLY

(71) Applicant: Wilcox Industries Corp., Newington, NH (US)

(72) Inventors: James W. Teetzel, Portsmouth, NH (US); Gary M. Lemire, Lee, NH (US)

(73) Assignee: Wilcox Industries Corp., Newington, NH (US)

( * ) Notice: Subject to any disclaimer, the term of this patent is extended or adjusted under 35 U.S.C. 154(b) by 141 days.

(21) Appl. No.: 17/500,684

(22) Filed: Oct. 13, 2021

(65) Prior Publication Data

US 2022/0202126 A1 Jun. 30, 2022

Related U.S. Application Data

(60) Provisional application No. 63/092,140, filed on Oct. 15, 2020.

(51) Int. Cl.
*A42B 3/04* (2006.01)

(52) U.S. Cl.
CPC ..... *A42B 3/042* (2013.01); *A42B 3/0406* (2013.01)

(58) Field of Classification Search
CPC .. A42B 1/24; A42B 1/242; A42B 3/04; A42B 3/0406; A42B 3/042; A42B 3/0426; A42B 3/0433; A42B 3/044; A42B 3/0453; A42B 3/0466; A42B 3/18; A42B 3/185; A42B 3/20; A42B 3/22; A42B 3/221; A42B 3/222; A42B 3/223; A42B 3/225; A42B 3/227; A42B 3/228; A42B 3/30; F41H 1/04; F41H 1/06; F41H 1/08; G02B 23/125
USPC ..... 2/422, 424, 6.2
See application file for complete search history.

(56) References Cited

U.S. PATENT DOCUMENTS

| | | | | |
|---|---|---|---|---|
| 7,219,370 | B1 * | 5/2007 | Teetzel | A42B 3/042 2/6.2 |
| 9,775,395 | B2 * | 10/2017 | Teetzel | A42B 3/042 |
| 10,264,840 | B2 * | 4/2019 | Teetzel | A42B 3/042 |
| 2010/0175172 | A1 * | 7/2010 | Dempsey | A42B 3/042 2/422 |
| 2011/0072562 | A1 * | 3/2011 | Prendergast | G02B 27/0176 89/926 |
| 2015/0026872 | A1 * | 1/2015 | Giroux Bernier | A42B 3/04 29/428 |
| 2015/0074878 | A1 * | 3/2015 | Teetzel | A42B 3/04 2/422 |
| 2015/0282549 | A1 * | 10/2015 | Lebel | A42B 3/042 2/422 |

(Continued)

*Primary Examiner* — Jameson D Collier
*Assistant Examiner* — Matthew R Marchewka
(74) *Attorney, Agent, or Firm* — McLane Middleton, Professional Association

(57) ABSTRACT

A shroud assembly for headgear includes a frame having a first side configured to face toward an exterior surface of the headgear and a second side opposite the first side and configured to face away from the headgear, the first side having a shape that matches a contour of the headgear. An insert separately formed from the frame is removably attached to the first side of the frame, the insert configured for removable attachment to a mounting assembly. The frame includes first and second spaced apart walls disposed on the front side of the frame on opposite sides of the insert, the first and second walls spaced a sufficient distance apart to provide an interference fit between the mounting assembly and the first and second spaced apart walls.

29 Claims, 16 Drawing Sheets

(56) References Cited

U.S. PATENT DOCUMENTS

| | | | | |
|---|---|---|---|---|
| 2017/0049176 | A1* | 2/2017 | Giroux Bernier | A42B 3/04 |
| 2020/0205505 | A1* | 7/2020 | Kim | A42B 3/185 |

* cited by examiner

HEADGEAR SHROUD ASSEMBLY

CROSS REFERENCE TO RELATED APPLICATION

This application claims the priority benefit of U.S. provisional application No. 63/092,140 filed Oct. 15, 2020. The aforementioned application is incorporated herein by reference in its entirety.

INCORPORATION BY REFERENCE

This application is related to U.S. nonprovisional application Ser. No. 15/708,523 filed Sep. 19, 2017, now U.S. Pat. No. 10,264,840; U.S. nonprovisional application Ser. No. 14/483,471, filed Sep. 11, 2014, now U.S. Pat. No. 9,775,395; and U.S. provisional application 61/878,901 filed Sep. 17, 2013. Each of the aforementioned applications is incorporated herein by reference in its entirety.

BACKGROUND

The present invention relates to an improved shroud for mounting an accessory device to headgear. The shroud described herein may advantageously be used in connection with mounting assemblies for attaching night vision devices and will be described herein primarily by way of reference thereto. However, it will be recognized that the shroud herein may be used with all manner of helmet or other headgear mounted accessory devices.

Night vision devices are used by military personnel, law enforcement personnel, and so forth when conducting military or tactical operations at night or under other low light conditions. Commonly, a mounting system is employed on the front of the user's headgear, such as a field helmet, to provide hands free support of the night vision device in front of the eyes of the user. Such helmet mount assemblies typically provide vertical, lateral, fore-and-aft, and tilt adjustment mechanisms for alignment of an attached night vision device with the eye or in the case of a binocular device eyes of the user. Mounting systems are known which allow the user to pivot the night vision device up to a stowed position out of the user's line of sight when not in use without removing the night vision device from the helmet.

Although helmet mounting assemblies are known that allow the user to pivot the night vision device out of the way when the night vision device is not in use, it is often desirable to completely remove the night vision system and the mounting system from the headgear, e.g., during the daytime, in order to reduce helmet weight and strain on the user's neck, in situations where entanglement hazards exist, etc. Commonly, helmet mount assemblies are made removably attachable to a helmet through the use of a mounting bracket or shroud, as described, for example, in commonly owned U.S. Pat. No. 7,219,370. Such shrouds attach to the headgear with threaded fasteners using one or more holes drilled through the helmet. Standardized hole patterns have been developed, such as a single hole pattern compatible with standards of the U.S. Army and a three-hole pattern compatible with standards adopted by the Marine Forces Special Operations Command (MARSOC) and United States Navy Special Warfare Command (WARCOM). The use of standard hole patterns allows helmets to be pre-drilled to accept any shroud compatible with that hole pattern.

Typically, such helmet shrouds are machined using aluminum or other metal and include a receptacle for removable attachment of the mounting assembly. It has been found, however, that the manufacturing tolerances of the prior art shrouds are such that there is generally some clearance between the receptacle of the shroud and the interfacing portion of the mounting system, which results in a small amount of movement or play between the shroud and the mounting assembly. It has also been found that the process of repeated removal and attachment of the night vision mount creates wear, resulting in greater clearance and play between the shroud and the mounting assembly.

The present disclosure contemplates a new and improved shroud assembly that overcomes the above-referenced problems and others.

SUMMARY

In one aspect, a shroud assembly for headgear includes a frame having a first side configured to face toward an exterior surface of the headgear and a second side opposite the first side and configured to face away from the headgear, the first side having a shape that matches a contour of the headgear. A first insert is separately formed from the frame and removably attached to the first side of the frame. The first insert is configured for removable attachment to a mounting assembly. The frame includes first and second spaced apart walls disposed on the front side of the frame on opposite sides of the first insert, the first and second walls spaced a sufficient distance apart to provide an interference fit between the mounting assembly and the first and second spaced apart walls.

In a more limited aspect, the frame has a central opening defining a peripheral edge and the first insert includes a central area received in the central opening and one or more fastening areas extending from the central area. One or more fasteners couple the one or more fastening areas to the first side of the frame adjacent the peripheral edge.

In another more limited aspect, the frame is formed of a material selected from a polymer material.

In another more limited aspect, the frame is formed of an injection moldable thermoplastic resin.

In another more limited aspect, the frame is formed of a fiber reinforced polymer matrix composite material.

In another more limited aspect, the frame is formed of a glass fiber reinforced polyimide matrix composite material.

In another more limited aspect, the first insert is formed of a metal or metal alloy.

In another more limited aspect, the first and second walls extend vertically on opposite lateral sides of the first insert.

In another more limited aspect, the first and second spaced apart walls are flexible.

In another more limited aspect, the first and second walls are configured to be displaced outward when the mounting assembly is removably attached to the first insert.

In another more limited aspect, the first and second walls have a tapered inward facing surface to facilitate insertion of the mounting system.

In another more limited aspect, the first insert defines one or more receptacles configured to removably mate with a latch member of the mounting assembly.

In another more limited aspect, at least one opening in the frame is configured to receive a mechanical fastener for attaching the shroud assembly to the headgear.

In another more limited aspect, first, second, and third openings in the frame are configured to receive a mechanical fastener for attaching the shroud assembly to the headgear.

In another more limited aspect, the first, second, and third openings are positioned in accordance with a promulgated standard for helmet drill hole patterns.

In another more limited aspect, the promulgated standard is a three-hole pattern.

In another more limited aspect, a friction pad is removably attached to the second side of the frame for increasing friction between the shroud assembly and the helmet, wherein the first insert is disposed intermediate the frame and the friction pad.

In another more limited aspect, at least one boss protrudes from the friction pad and extends through a complementary opening in the frame.

In another more limited aspect, a first opening in the first insert, a second opening in the frame, and a third opening in the friction pad, are aligned with an opening in the helmet for receiving a mechanical fastener for attaching the shroud assembly to the helmet.

In another more limited aspect, the position of the first opening corresponds to a military standard helmet single drill hole pattern.

In another more limited aspect, fourth, fifth, and sixth openings are provided in the frame and seventh, eight, and ninth openings are provided in the friction pad, wherein the seventh, eight, and ninth openings are aligned with the fourth, fifth, and sixth openings, respectively. A removable plug is received in each of the seventh, eight, and ninth openings.

In another more limited aspect, each plug has a protrusion extending into a respective one of the fourth, fifth, and sixth openings in the frame.

In another more limited aspect, the fourth, fifth, and sixth openings in the frame are positioned in accordance with a standard helmet drill hole pattern.

In another more limited aspect, the shroud assembly further comprises the mounting assembly, wherein the mounting assembly is a night vision device mounting assembly.

In another more limited aspect, the shroud assembly further comprises a second insert interchangeably attachable to the frame in place of the first insert.

In a second aspect, a helmet assembly comprises a helmet having an exterior surface, the helmet including one or more holes, a left side portion, a right side portion, and a front portion extending between the left side portion and the right side portion. A shroud assembly includes a frame removably attached to the front portion of the helmet and has a first side configured to face toward the exterior surface of the helmet and a second side opposite the first side configured to face away from the helmet. The first side has an interior curve shape that matches an exterior curve shape of the helmet. An insert is separately formed from the frame and removably attached to the first side of the frame. The insert is configured for removable attachment to a mounting assembly for a night vision device. The frame includes first and second spaced apart walls disposed on the front side of the frame on opposite sides of the insert, the first and second walls being spaced a sufficient distance apart to provide an interference fit between the mounting assembly and the first and second spaced apart walls.

In a more limited aspect, the shroud assembly is removably attached to the helmet by one or more fasteners, each of the one or more fasteners extending through a corresponding aligned hole in the helmet and a corresponding aligned hole in the shroud assembly.

In another more limited aspect, the shroud assembly is removably attached to the helmet by fasteners extending through an aligned hole in the helmet and an aligned hole in the insert.

In another more limited aspect, a friction pad is disposed between the helmet and the shroud assembly.

In another more limited aspect, the shroud assembly is removably attached to the helmet by three fasteners, each fastener extending through a corresponding aligned hole in the helmet and a corresponding aligned hole in the frame.

In a third aspect, a method for attaching a mounting assembly to helmet comprises providing a shroud assembly by removably attaching an insert to a first side of a frame. The insert is separately formed from the frame and removably attached to the first side of the frame. The insert is configured for removable attachment to the mounting assembly. The frame has a second side opposite the first side, the first side configured to face toward an exterior surface of the helmet and the second side configured to face away from the helmet. The first side has a shape that matches a contour of the helmet. The frame includes first and second spaced apart walls disposed on the front side of the frame on opposite sides of the insert, the first and second walls spaced a sufficient distance apart to provide an interference fit between the mounting assembly and the first and second spaced apart walls.

In a more limited aspect, the shroud assembly further includes a friction pad removably attached to the second side of the frame for increasing friction between the shroud assembly and the helmet, wherein the insert is disposed intermediate the frame and the friction pad.

In another more limited aspect, the method includes removably attaching a night vision device to the mounting assembly.

One advantage of the present development resides in its ability to prevent relative movement or play between the mounting assembly and the shroud.

Another advantage of the present development is found in the weight reduction that can be achieved by making a portion of the shroud assembly from a polymer material.

Yet another advantage resides in the strengthening of the connection between the frame and the insert.

Still further advantages and benefits of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

Figure 1:
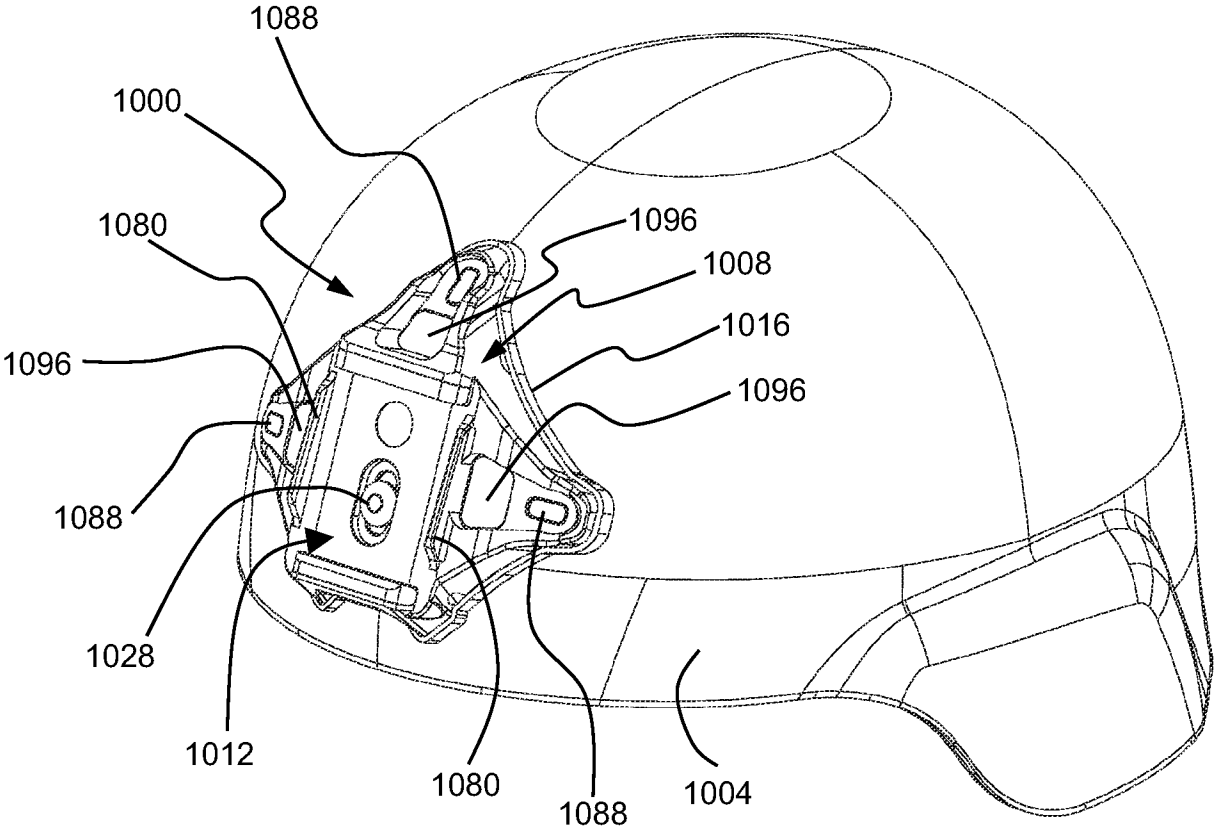
FIG. 1 is an isometric view of a shroud assembly according to a first exemplary embodiment, attached to a helmet.
Figure 2:
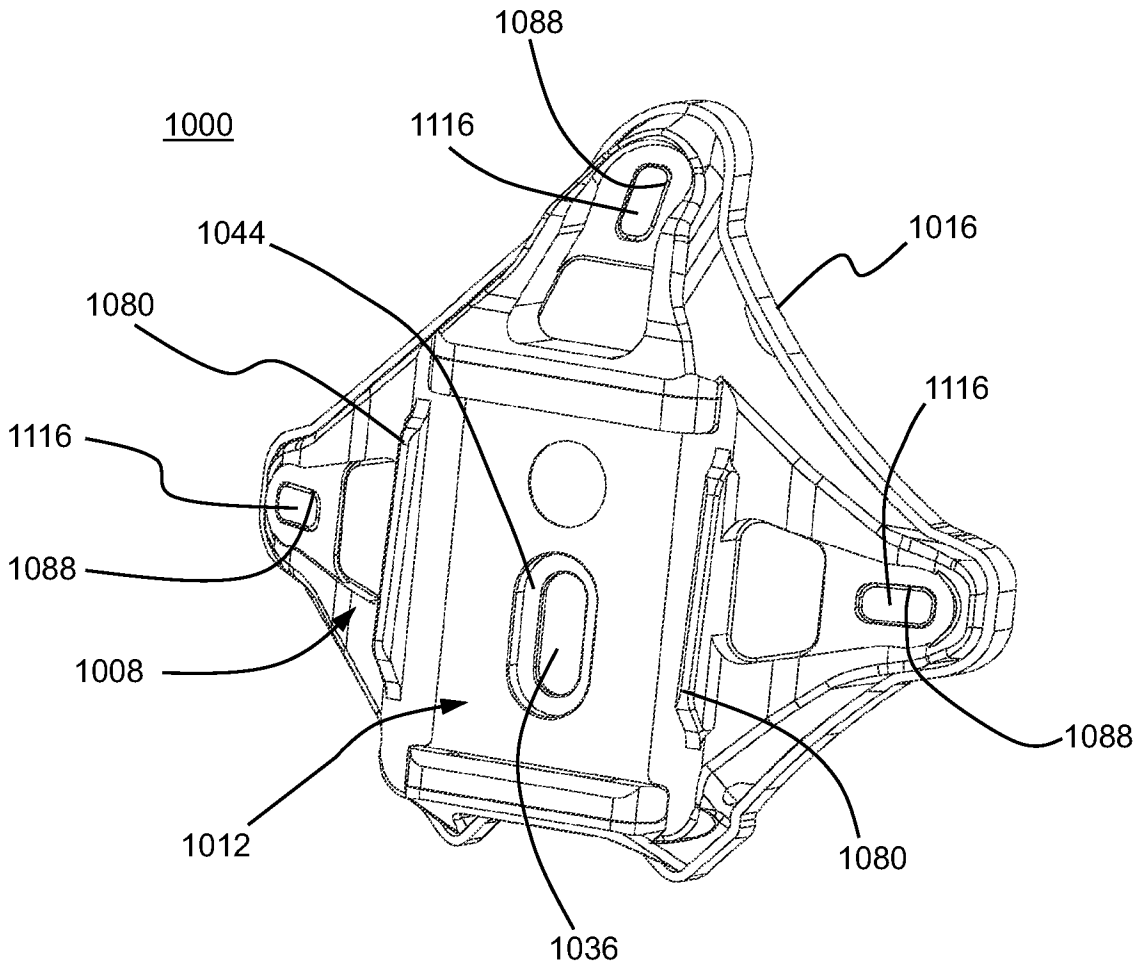
FIG. 2 is an enlarged isometric view of the shroud assembly appearing in FIG. 1.
Figure 3:
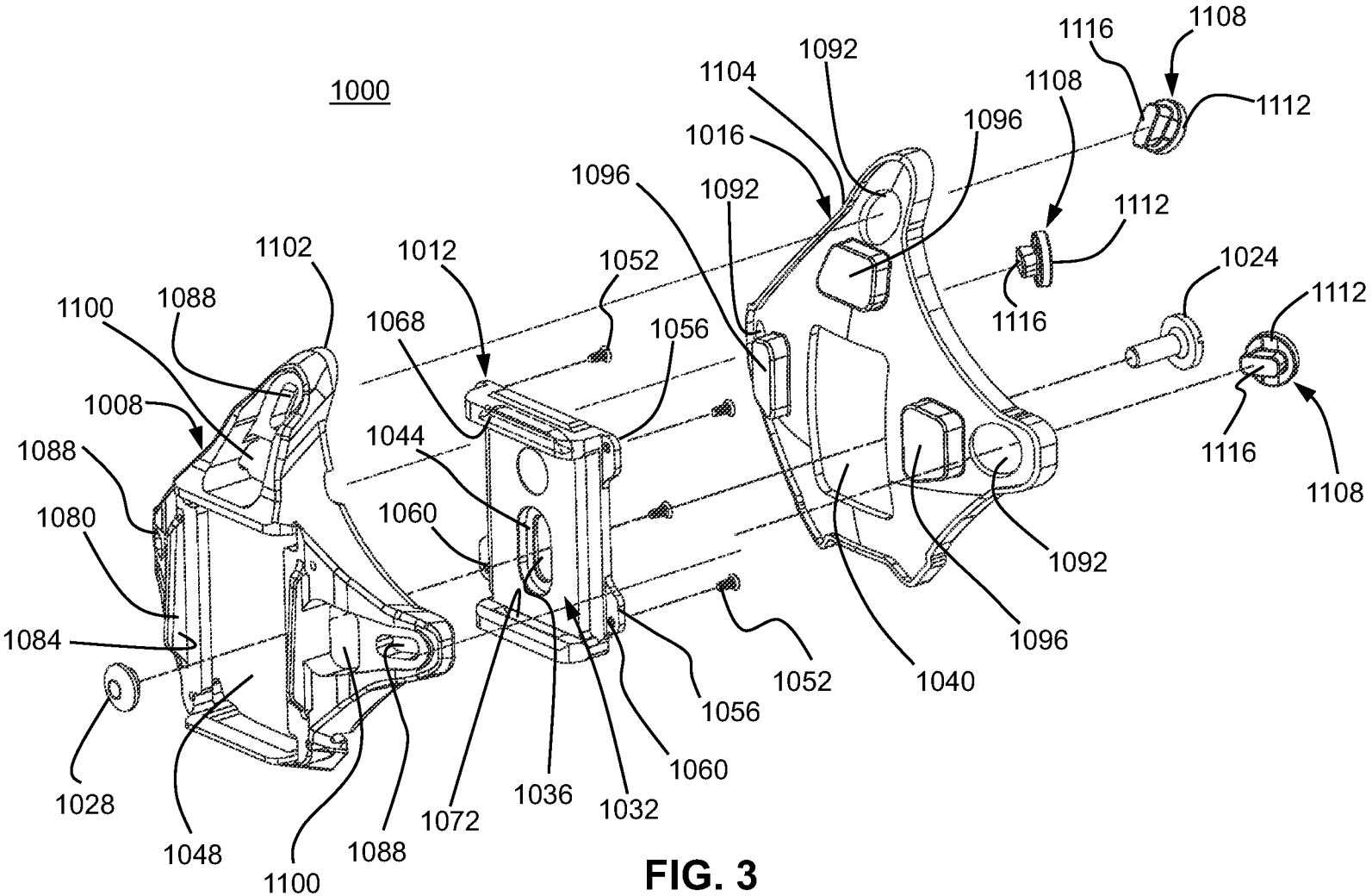
FIG. 3 is an exploded view of the shroud assembly appearing in FIG. 1 taken generally from the front and side.
Figure 4:
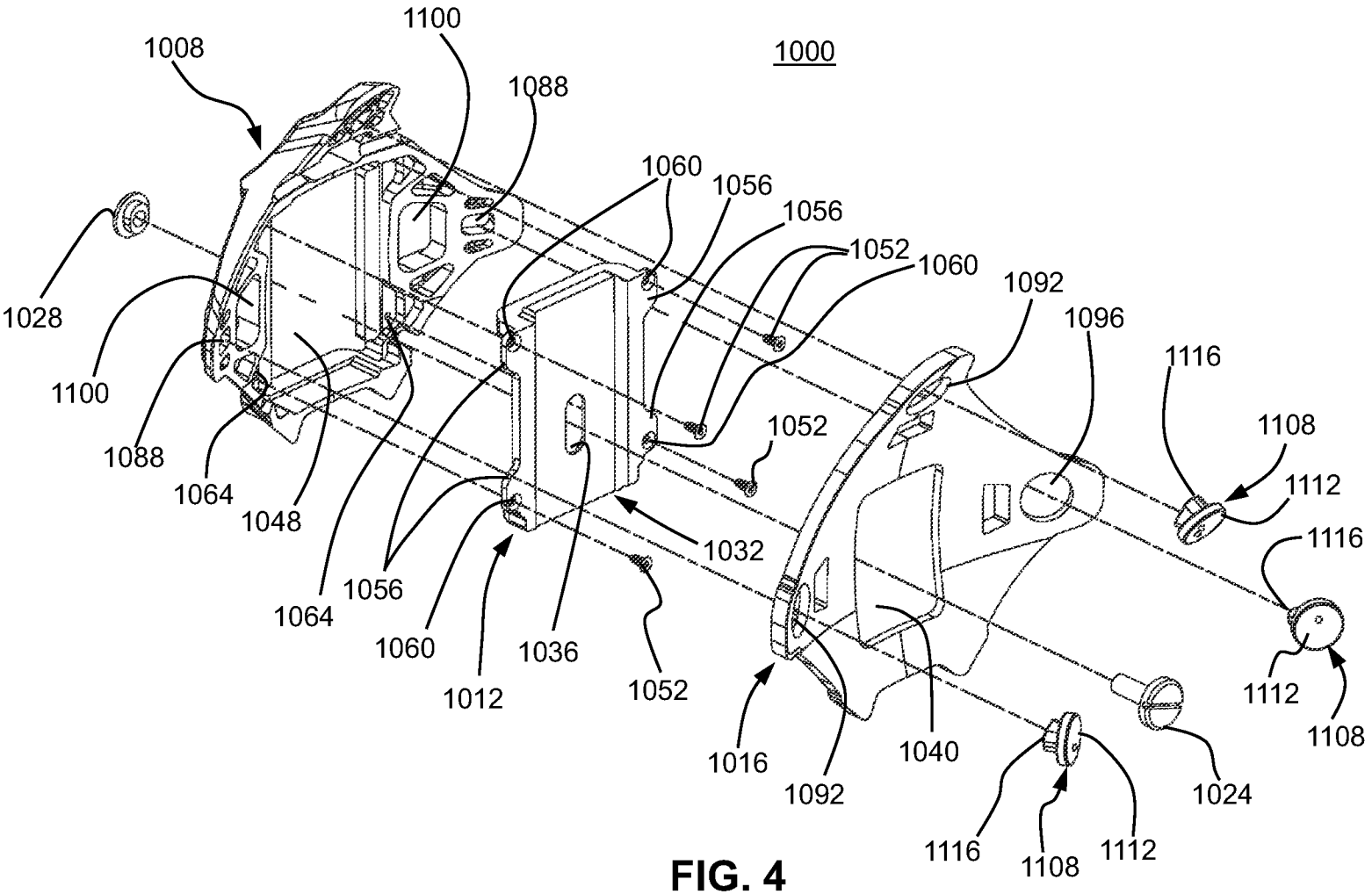
FIG. 4 is an exploded view of the shroud assembly appearing in FIG. 1 taken generally from the rear and side.
Figure 5:
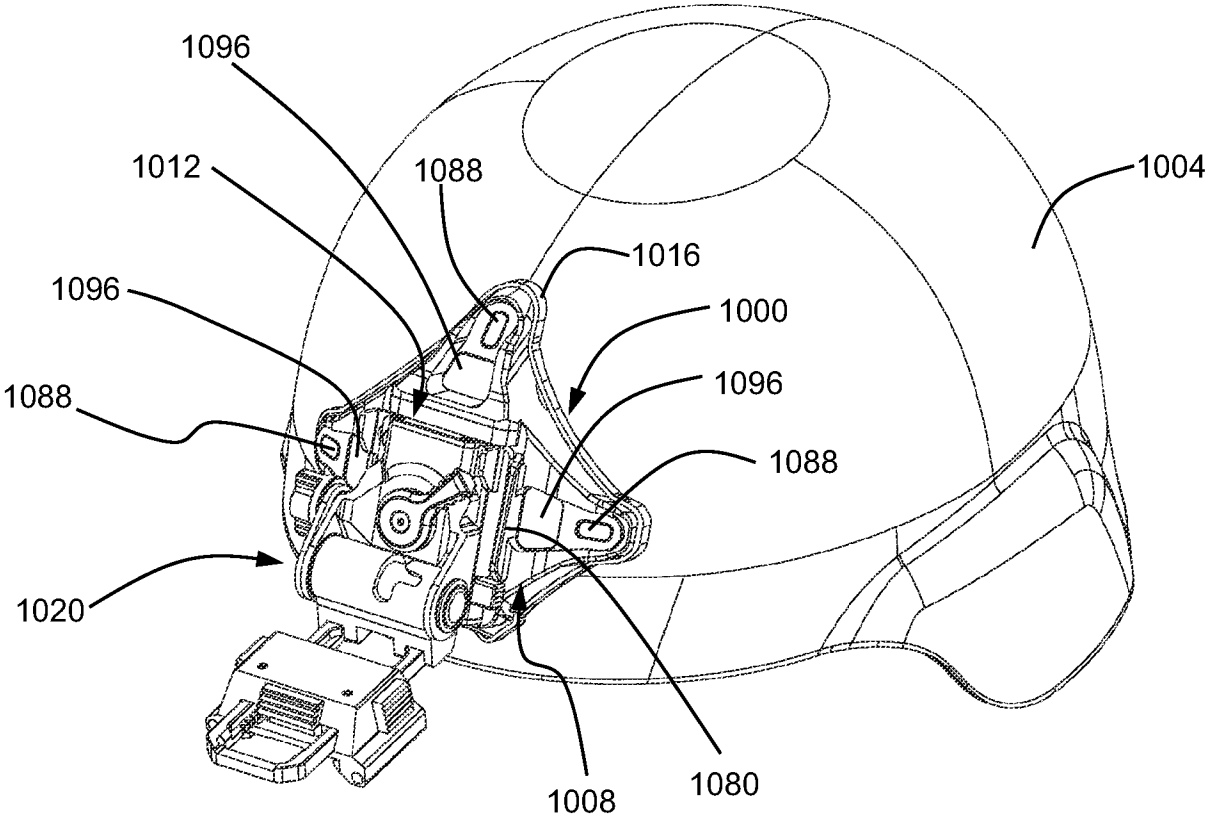
FIGS. 5 and 6 illustrate a helmet with the shroud assembly appearing in FIG. 1 with a helmet mounting apparatus removably attached (FIG. 5) and detached (FIG. 6).
Figure 6:
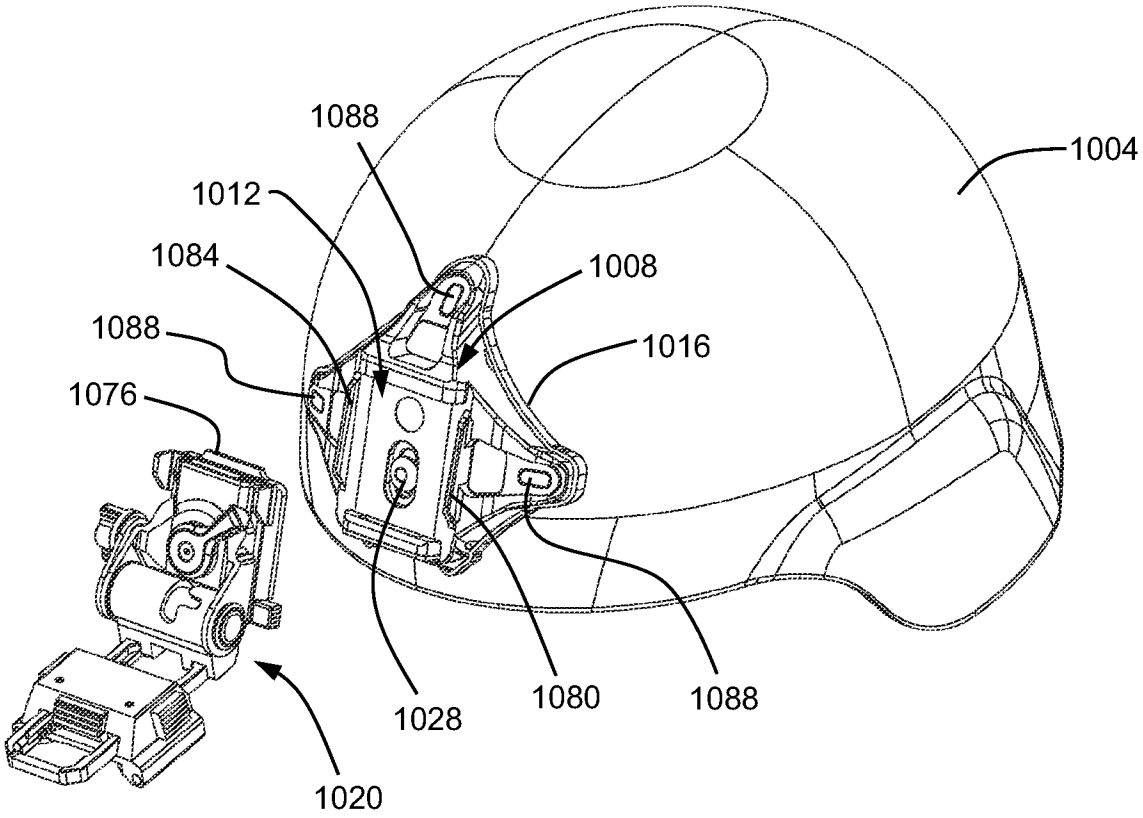
Figure 7:
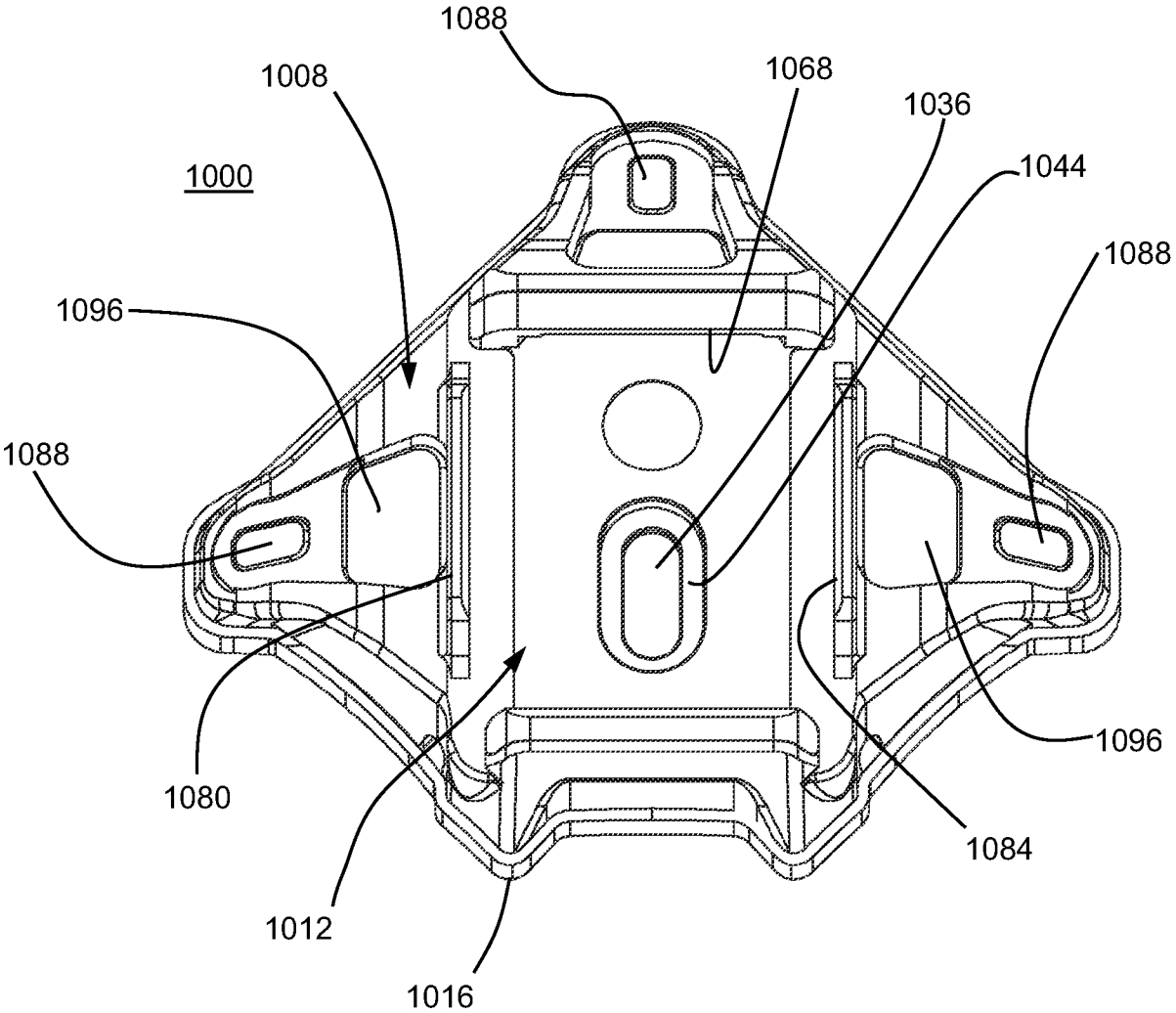
FIG. 7 is a front elevational view of the shroud assembly appearing in FIG. 1.
Figure 8:
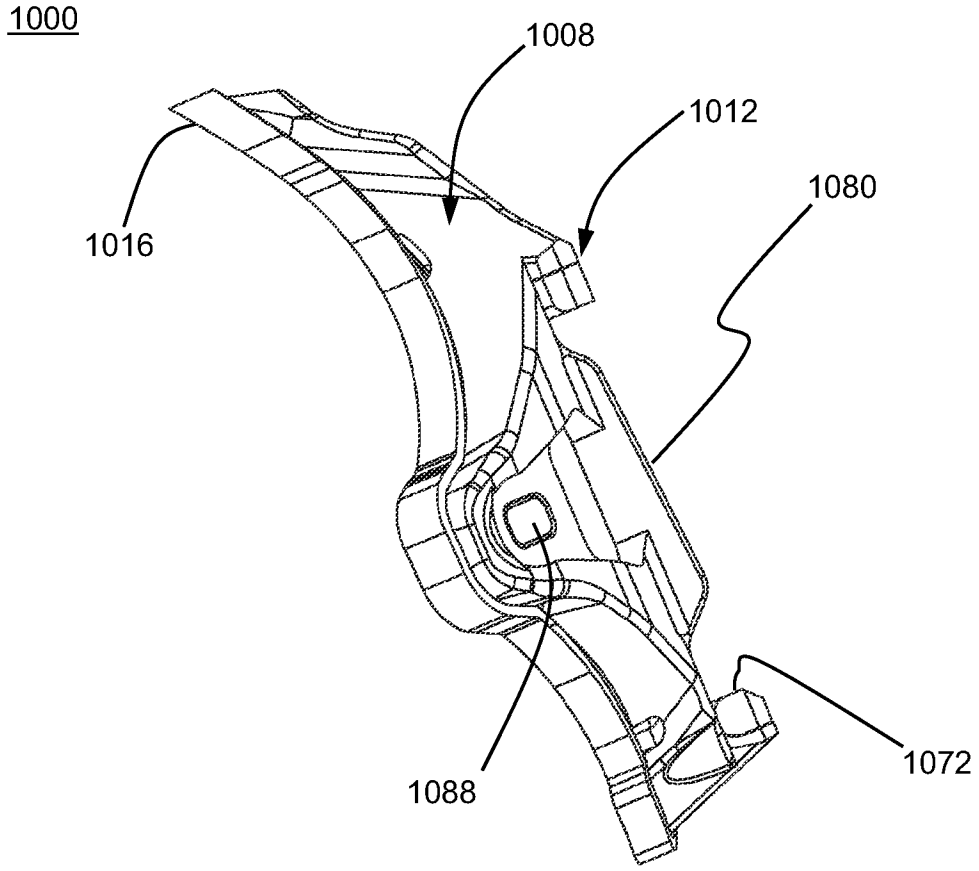
FIG. 8 is a left side elevational view of the shroud assembly appearing in FIG. 1, the right side view being a mirror image thereof.
Figure 9:
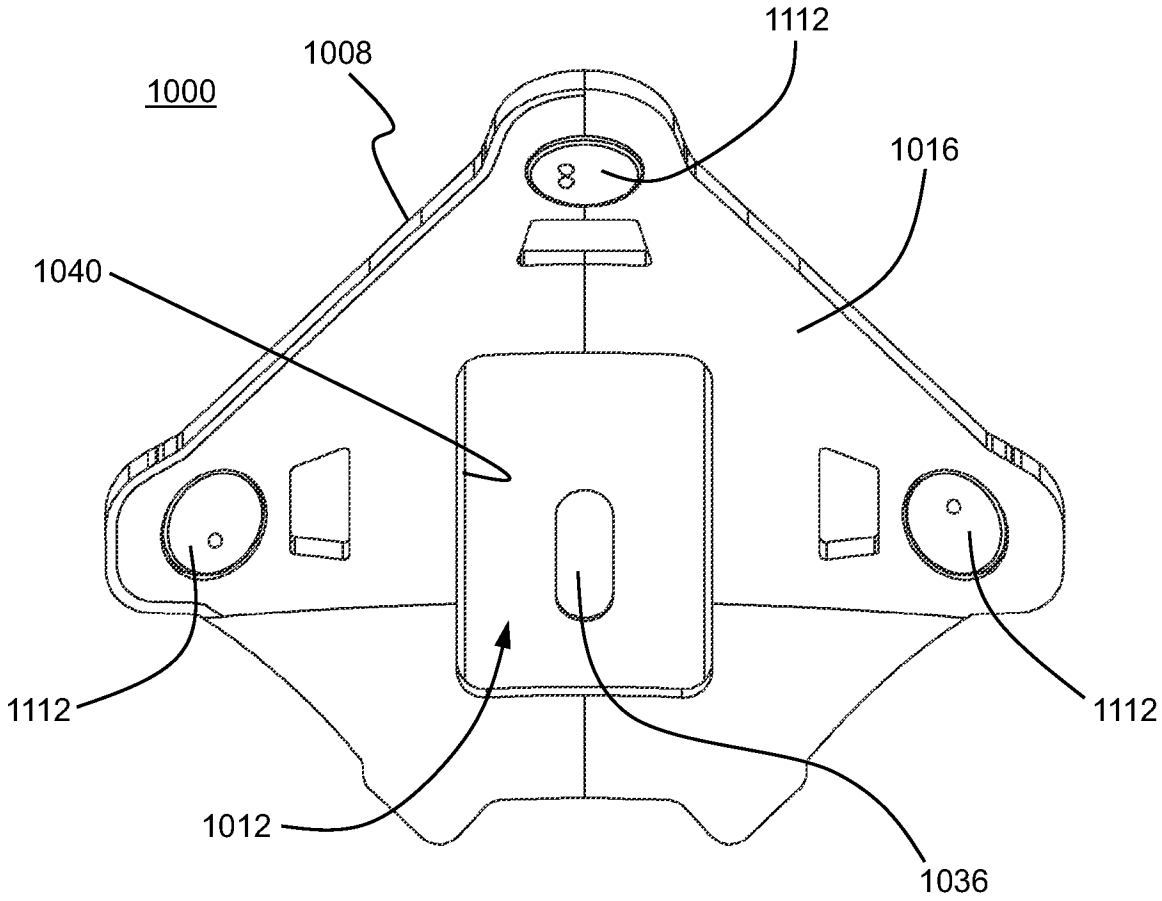
FIG. 9 is a rear elevational view of the shroud assembly appearing in FIG. 1.

Referring now to the drawings, FIGS. 1-9 illustrate a first embodiment shroud assembly, designated generally as 1000, for attachment to the front of a helmet 1004. For the sake of brevity, the present shroud assembly will be described herein primarily by way of reference to use with night vision systems. However, it will be recognized that the present shroud assembly is also amenable for use with all manner of monocular and binocular devices, including optical viewing devices, thermal cameras, head up displays, virtual reality goggles, or other electronic or optoelectronic imaging devices.

The shroud assembly 1000 includes a frame 1008, an insert 1012 removably attachable to the frame 1008, and an optional backing pad or friction pad 1016. The shroud assembly 1000 is primarily intended for use in connection with a helmet 1004 having a single mounting hole, such as the standard one-hole mounting pattern, and will be described primarily by way of reference thereto. It will be recognized, however, that the shroud assembly 1000 could likewise be used with or without the backing pad 1016 with a helmet having holes drilled in a three hole mounting pattern, such as the standard three-hole pattern used by MARSOC and WARCOM, in the same manner as detailed below in connection with the shroud assembly 2000.

The shroud assembly 1000 provides an interface for the removable attachment of a helmet mount assembly 1020, such as a night vision mounting system. The helmet mount 1020 assembly may be, for example, a night vision mounting system in the L4 product line available from Wilcox Industries Corp. of Newington, NH It will be recognized that the present shroud assembly can be adapted for use with all manner of helmet mount assemblies by providing an insert 1012 which has retention features complementary with a desired helmet mount assembly. In certain embodiments, the frame may be provided with a plurality of interchangeable metal inserts to provide a modular system capable of being used with multiple types of helmet mounting systems.

The frame 1008 and the friction pad 1016 each have a generally concave rearward surface which is shaped to generally conform to the shape of the helmet 1004. In certain embodiments, the frame 1008 is formed of a polymer material, although other materials are contemplated. Exemplary polymer materials suitable for forming the frame 1008 include, for example, nylon, polyamide, fiber reinforced polymer composite materials such as glass fiber-filled polyamides, polyethermide (PEI), and polycarbonate (PC). In certain embodiments, the frame 1008 is formed by molding, e.g., injection molding, machining, additive manufacturing, or the like.

In certain embodiments, the insert 1012 is formed of a metal or metal alloy, although other materials are contemplated. Exemplary metal/metal alloy materials suitable for forming the insert 1012 include, titanium, aluminum, e.g., 6000 series aluminum or 7000 series aluminum, preferably 6061-T6 aluminum or 7075-T6 aluminum. In certain embodiments, the insert is formed by machining, molding, e.g., metal injection molding (MIM), additive manufacturing, or the like.

The friction pad 1016 may be formed of natural or synthetic rubber or other elastomer material. The pad 1016 increases the friction between the shroud assembly 1000 and the helmet 1004 and is particularly advantageous for use with a helmet 1004 having a one-hole pattern to prevent rotation of the unit 1000 about the fasteners 1024, 1028 which secure the shroud assembly 1000 to the helmet 1004.

The insert 1012 is preferably formed by machining although cast, molded, and additively manufactured inserts 1012 are also contemplated. The insert 1012 is preferably formed of aluminum or aluminum alloy. In the illustrated preferred embodiment, the insert 1012 includes a central portion 1032 having an opening 1036 for receiving the threaded fastener 1024. The opening 1036 may be elongated in the vertical direction to provide vertical adjustability when mounting the shroud assembly 1000, e.g., to accommodate differences between the drilled hole placement on the helmet, accommodate edge trim on the brim of the helmet, and so forth.

The threaded fastener 1024 passes through a hole (not shown) in the helmet 1004, a large central opening 1040 in the friction pad 1016, and the hole 1036 in the insert 1012. The fastener 1024 is secured via a complementary threaded fastener or nut 1028 received in a counterbore 1044 of the opening 1036.

The insert 1012 is disposed on the inward facing (i.e., helmet facing) side of the frame 1008. The friction pad 1016, in turn, is disposed on the inward facing (i.e., helmet facing) side of the frame 1008 and friction pad 1016. The central portion 1032 of the insert 1012 extends into or through a large central opening 1048 in the frame 1008. In contrast to shrouds having an insert on the exterior side of the frame, wherein the strength of the interface between the frame and insert is defined by the fasteners securing them together, by disposing the insert on the rear side of the frame, the attachment between the frame and the insert becomes stronger in that the interface between the frame and the insert essentially becomes the length of the insert.

The insert 1012 is removably secured to the inward side of the frame 1008 in alignment with the central opening 1048 via one or more threaded fasteners 1052. The insert 1012 includes a central portion 1032 received in the opening 1048 in frame 1008. The insert 1012 includes one or more fastening portions 1056 extending from the central portion 1048 that extend beyond the edge of the opening 1032. The fastening portion(s) 1056 each include an opening 1060 which is aligned with a corresponding opening 1064 on a rear surface of the frame 1008. The threaded fasteners 1052 pass through the openings 1060 and removably engage the openings 1064. The insert 1012 includes features, such as an upper recess 1068 and a lower recess 1072, for removably engaging respective latch members 1076 formed on the mounting system 1020.

In certain embodiments, the frame 1008 is formed of an injection moldable plastic, such as a thermoplastic resin, although thermosetting polymers are also contemplated. In preferred embodiments, the frame 1008 is formed of a fiber reinforced polymer matrix composite material. Reinforcing fibers for polymer matrix composite materials are generally known. Exemplary fibers include carbonaceous fibers (e.g., carbon or graphite fibers), glass fibers, and other filamentary materials. In an especially preferred embodiment, the frame 1008 is formed of a 30% glass filled polyimide composite material.

A pair of walls or blades 1080 extends from the face of the frame 1008 immediately adjacent the central opening 1048 on opposite lateral sides thereof. In certain embodiments, the blades 1080 are formed of a polymer material that can flex and can therefore be spaced apart a distance that provides a snug, interference fit between the blades 1080 and the sides of an attached helmet mounting system 1020, even after many insertions and removals of the helmet mounting system. In this manner, side-to-side movement between the mounting system 1020 and the shroud assembly 1000 can be eliminated. This is in contrast to prior art metal shrouds which must be toleranced to provide a clearance fit between the shroud and the mounting system, allowing undesirable side-to-side movement between the shroud and the helmet mount. In certain embodiments, the use of a frame 1008 formed of a polymer provides a reduction of the weight of the shroud assembly 1000 as compared to prior art metal shrouds.

In certain embodiments, the blades 1080 include a tapered or angled surface 1084 on the interior facing side thereof to facilitate insertion of the mounting system 1020 and, where the frame 1008 is formed of a polymer or otherwise flexible material, outward flexing of the blades 1080 is facilitated.

The depicted preferred embodiment illustrates an exemplary shroud assembly adapted for use with a mounting assembly that has latches 1076 that move or provide tension in the vertical direction, such that the blades 1080 are disposed on opposite lateral sides of an attached mounting assembly. Other orientations of the blades 1080, however, are also contemplated. For example, in the case of a helmet mounting assembly having latch members that move and provide tensioning in a horizontal direction, the flexible blades 1080 could be oriented horizontally above and below the mounting assembly interfacing portion to eliminate up and down movement.

The frame 1008 is of a generally triangular construction and includes three openings 1088 at the corners. The friction pad 1016 is shaped to receive the frame 1008 on the outward facing surface of the friction pad 1016 in a stacked or nested arrangement. The pad 1016 includes three openings 1092 aligned with the openings 1088 at the corners of the frame 1008. The pad 1016 further includes three bosses or protrusions 1096, which are disposed intermediate the central opening 1040 and the openings 1092. When the frame 1016 and the friction pad 1016 are stacked in the assembled, nested configuration, the bosses 1096 extend through aligned openings 1100 in the frame 1008, to interlock the frame 1008 and the pad 1016 together.

The pad 1016 may include an upstanding peripheral lip or ridge 1104 on the forward facing surface thereof complementary in shape and sized to receive the peripheral edge 1102 of the frame 1008. The frame 1008 and pad 1016 are further secured via three plugs 1108 at the corners of the unit 1000. Each plug 1108 includes a base 1112 which is received in one of the openings 1092 in the pad 1016. Each plug 1108 further includes a protrusion 1116 that extends through a corresponding one of the openings 1088 in the frame 1008.

Figure 10:
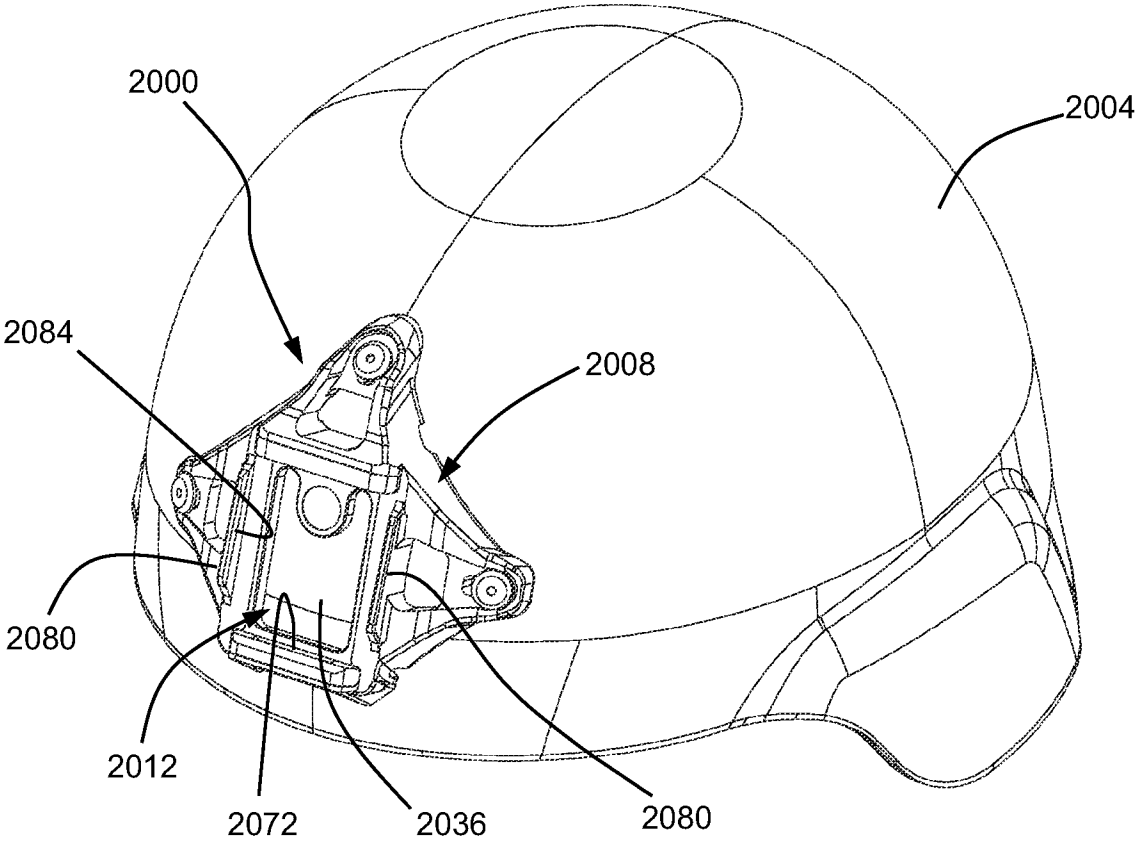
FIG. 10 illustrates a shroud assembly according to a second exemplary embodiment, attached to a helmet.
Figure 11:
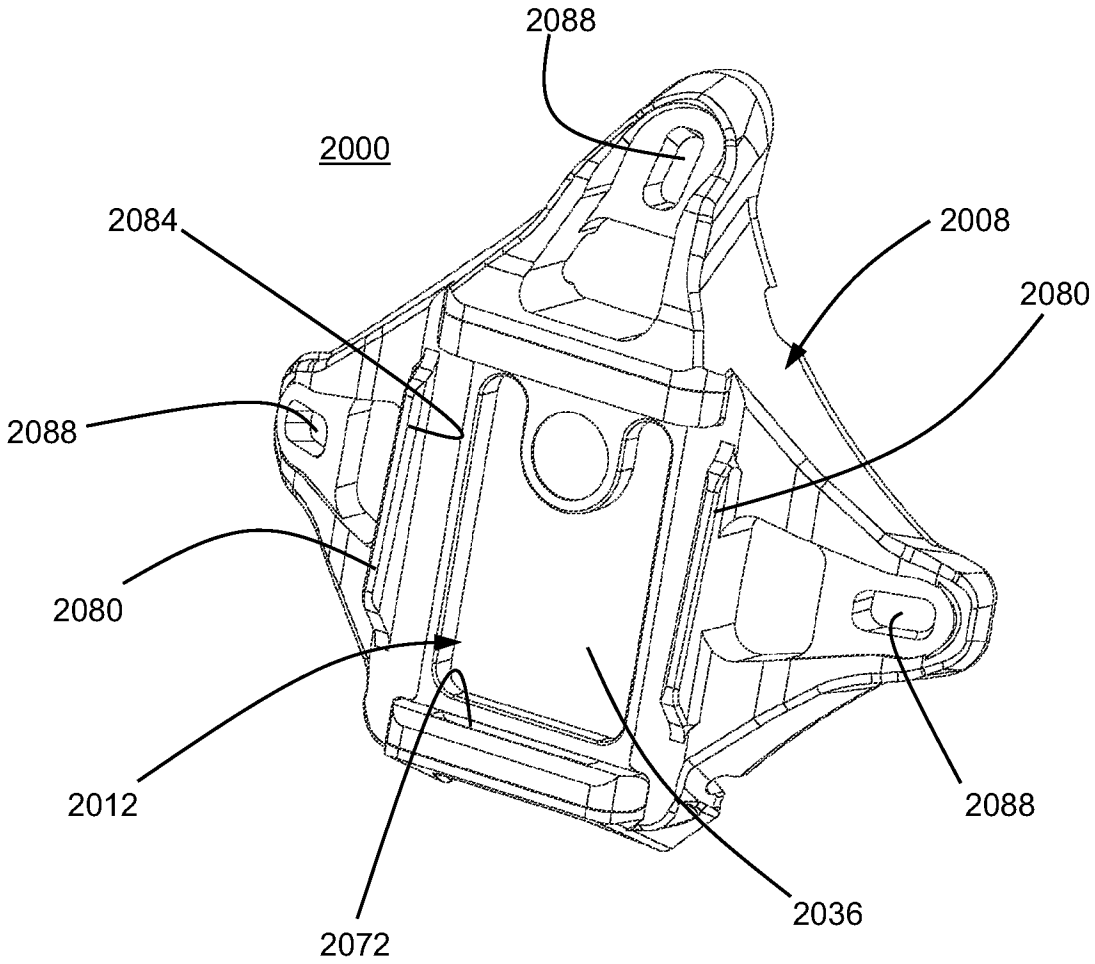
FIG. 11 is an enlarged isometric view of the shroud assembly appearing in FIG. 10.
Figure 12:
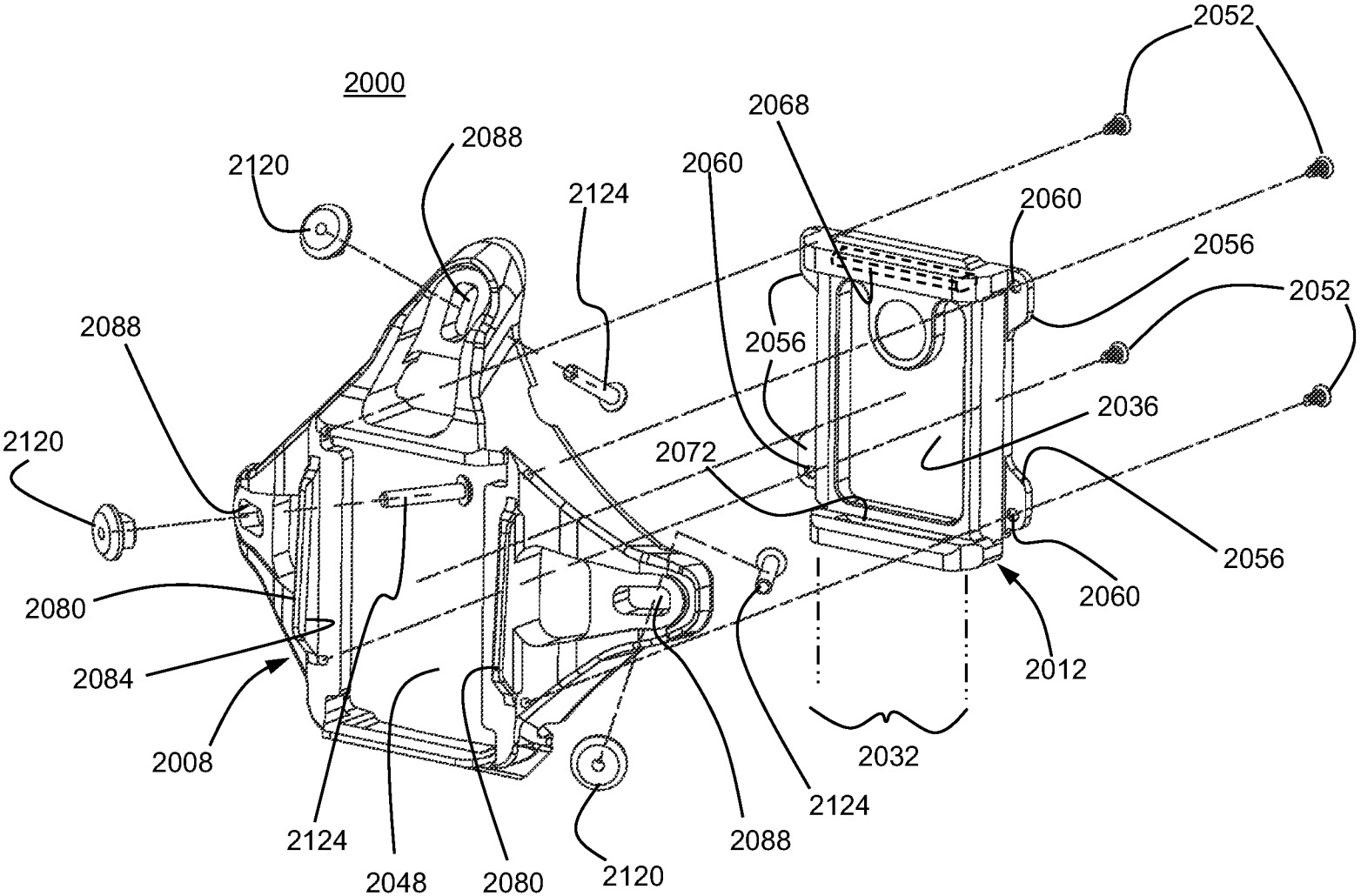
FIG. 12 is an exploded view of the shroud assembly appearing in FIG. 10, taken generally from the side and front.
Figure 13:
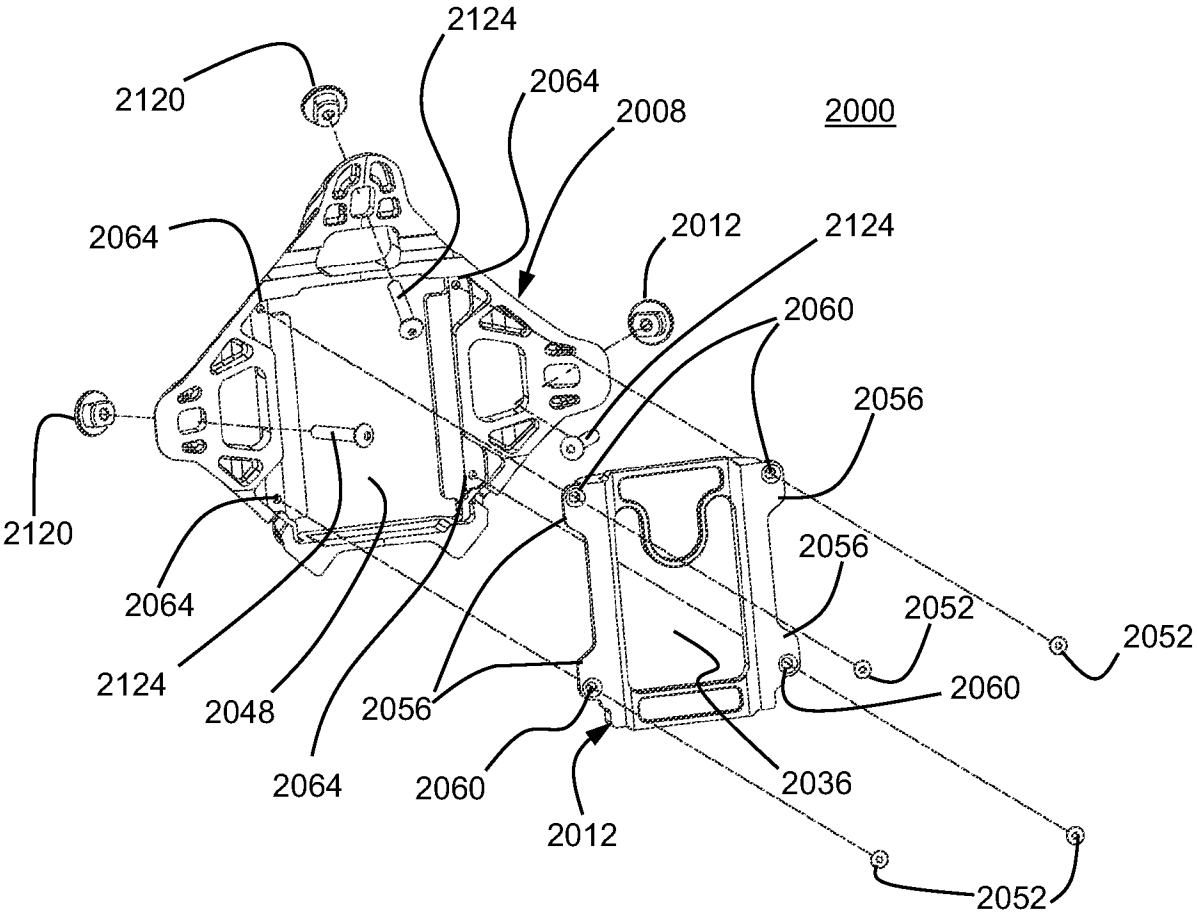
FIG. 13 is an exploded view of the shroud assembly appearing in FIG. 10, taken generally from the side and rear.
Figure 14:
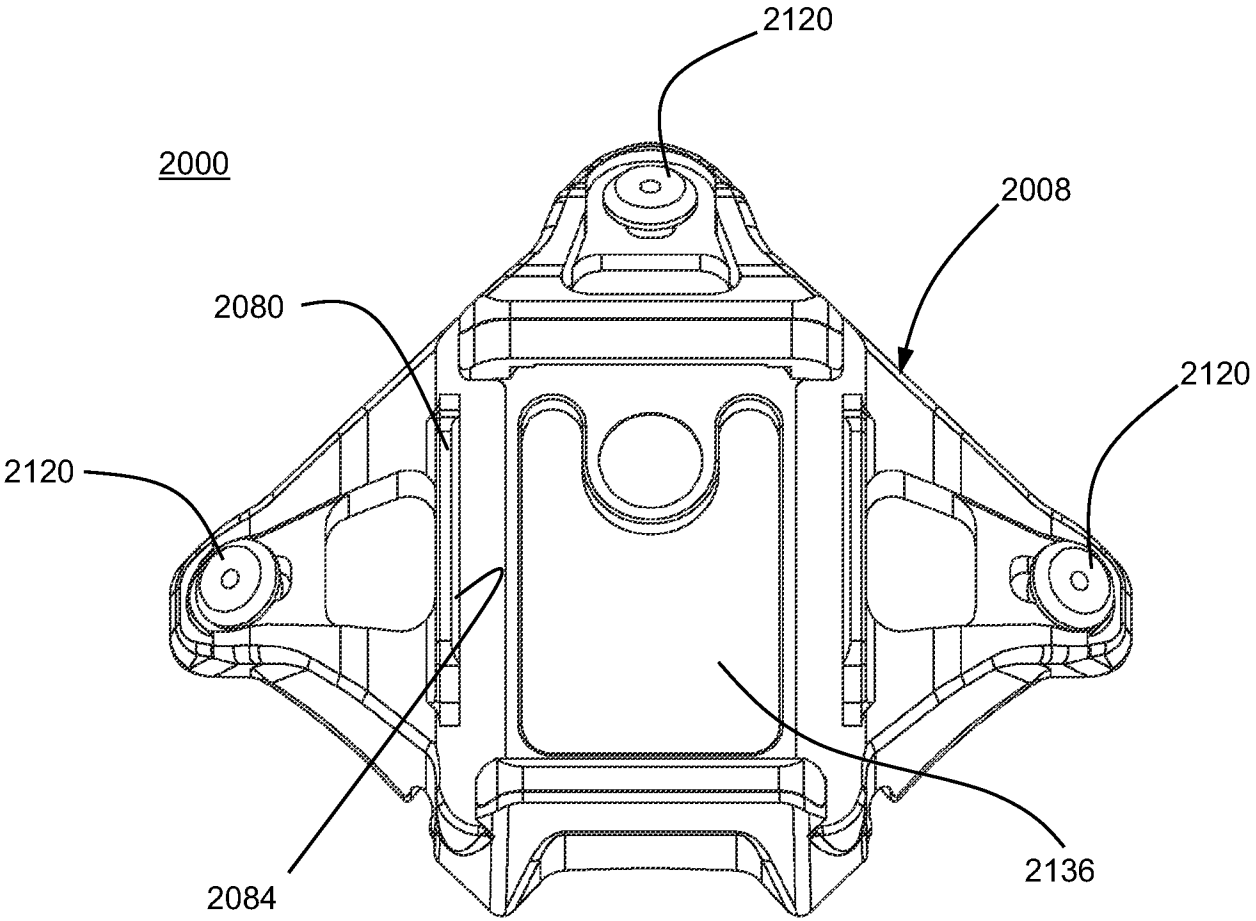
FIG. 14 is a front elevational view of the shroud assembly appearing in FIG. 10.
Figure 15:
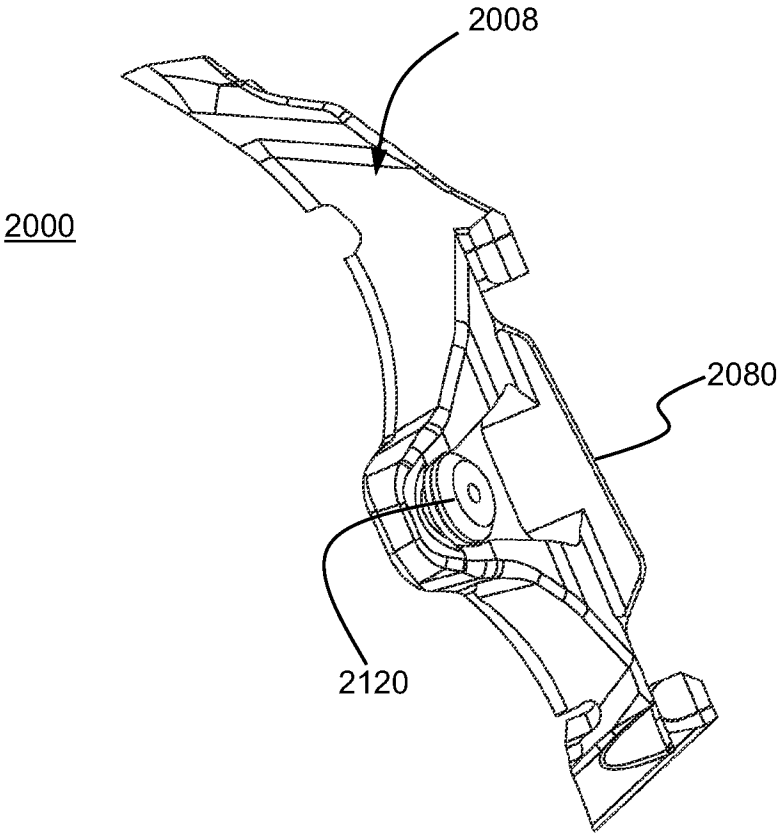
FIG. 15 is a left side elevational view of the shroud assembly appearing in FIG. 10, the right side view being a mirror image thereof.
Figure 16:
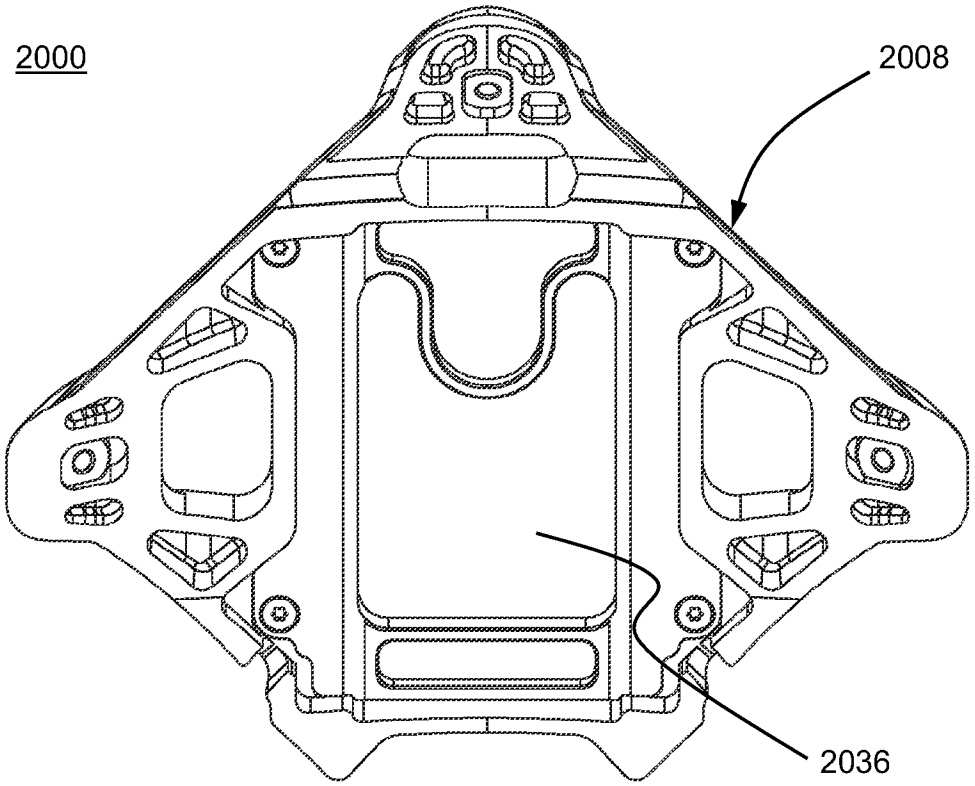
FIG. 16 is a rear elevational view of the shroud assembly appearing in FIG. 10.

In alternative embodiments, the plugs 1108 can be omitted, as well as the central helmet fasteners 1028, 1040, wherein the unit 1000 is secured to a helmet having a three-hole pattern, as described below in connection with FIGS. 10-16. In certain embodiments, the helmet drill/hole pattern may advantageously be the standard three-hole pattern used by MARSOC and WARCOM. It will be recognized that the unit 1000 could also be attached to a helmet using both the central hole 1036 via the fasteners 1024, 1028 as well as three threaded fasteners (see e.g., fasteners 2120, 2124 appearing in FIGS. 12 and 13) using the openings 1088; however, in general, it is preferable to use only the one hole pattern or the three hole pattern, since unnecessary holes drilled into the helmet can compromise the ballistic integrity of the helmet.

Referring now to FIGS. 10-16, a second embodiment shroud assembly, designated generally as 2000, for attachment to the front of a helmet 2004 is illustrated. The shroud assembly 2000 is similar to the embodiment 1000 described above, however, the friction pad is omitted.

The shroud assembly 2000 includes a frame 2008 and an insert 2012. Because the shroud assembly 2000 is intended for use with a three hole pattern, the insert 2012 need not include a central fastening hole. The frame 2008 and insert 2012 may be formed of materials and via manufacturing methods as described above by way of reference to the frame 1008 and insert 1012 appearing in the embodiment of FIGS. 1-9. In the illustrated preferred embodiment, an enlarged central opening 2036 is provided in the insert 2012 to reduce the weight of the shroud assembly 2000, thereby reducing the overall weight on the user's neck. However, the insert 2012 otherwise interfaces with the frame 2008 and a helmet mounting assembly (see, e.g., helmet mounting assembly 1020 appearing in FIGS. 5 and 6) in the manner as described above.

The mounting features of the insert 2012 may be modified depending on the particular helmet mounting system to be employed. A modular system may also be provided wherein multiple metal inserts 2012 are interchangeable to provide a system capable of being used with multiple types of helmet mounting systems.

The insert 2012 is disposed on the inward facing (i.e., helmet facing) side of the frame 2008. A central portion 2032 of the insert 2012 extends into or through a large central opening 2048 in the frame 2008. Again, in contrast to shrouds having an insert on the exterior side of the frame, wherein the strength of the interface between the frame and insert is defined by the fasteners securing them together, by disposing the insert on the rear side of the frame, a stronger the attachment between the frame and the insert is provided in that the interface between the frame and the insert essentially becomes the length of the insert.

The insert 2012 is removably secured to the inward side of the frame 2008 in alignment with the central opening 2048 via one or more threaded fasteners 2052. The central portion 2032 of the insert 2012 is received in the opening 2048 in frame 2008. The insert 2012 includes one or more fastening portions 2056 extending from the central portion 2048 that extend beyond the edge of the opening 2032. The fastening portion(s) each include an opening 2060 which is aligned with a corresponding opening 2064 on a rear surface of the frame 2008. The threaded fasteners 2052 pass through the openings 2060 and removably engage the openings 2064. The insert 2012 includes features, such as an upper recess 2068 and a lower recess 2072, for removably engaging respective latch members 1076 (see FIG. 6) formed on the mounting system 1020 (see FIGS. 5 and 6). The frame 2008 may be formed of an injection moldable plastic, and may be formed of the same materials as described above by way of reference to the frame 1008 (see FIGS. 1-9).

A pair of walls or blades 2080 extends from the face of the frame 2008 immediately adjacent the central opening 2048 on opposite lateral sides thereof. In certain embodiments, the blades 2080 are formed of a polymer material that can flex and can therefore be spaced apart a distance that provides a snug, interference fit between the blades 2080 and the sides of an attached helmet mounting system 1020 (see FIGS. 5 and 6), even after many insertions and removals of the helmet mounting system. In this manner, side-to-side movement between the mounting system 1020 and the shroud assembly 2000 can be eliminated. This is in contrast to prior art metal shrouds which must be toleranced to provide a clearance fit between the shroud and the mounting system, allowing undesirable side-to-side movement between the shroud and the helmet mount. In certain embodiments, the use of a frame 2008 formed of a polymer provides a reduction of the weight of the shroud assembly 2000 as compared to prior art metal shrouds.

In certain embodiments, the blades 2080 include a tapered or angled surface 2084 on the interior facing side thereof to facilitate insertion of the mounting system 1020 (see FIGS. 5 and 6) and, where the frame 2008 is formed of a polymer or otherwise flexible material, outward flexing of the blades 2080 is facilitated.

The depicted preferred embodiment illustrates an exemplary shroud assembly 2000 adapted for use with a mounting assembly that has latches 1076 (see FIG. 6) that move or provide tension in the vertical direction, such that the blades 2080 are disposed on opposite lateral sides of an attached mounting assembly. Other orientations of the blades 2080, however, are also contemplated. For example, in the case of a helmet mounting assembly having latch members that move and provide tensioning in a horizontal direction, the flexible blades 2080 could be oriented horizontally above and below the mounting assembly interfacing portion to eliminate up and down movement.

The frame 2008 is of a generally triangular construction and includes three openings 2088 at the corners. Threaded fasteners 2120 pass through the openings 2088 and engage complementary threaded fasteners 2124 passing through the helmet 2004 to secure the shroud assembly 2000 to the helmet 2004. The helmet drill/hole pattern may advantageously be the standard three-hole pattern used by MARSOC and WARCOM.

The invention has been described with reference to the preferred embodiments. Modifications and alterations will occur to others upon a reading and understanding of the preceding detailed description. It is intended that the invention be construed as including all such modifications and alterations insofar as they come within the scope of the appended claims or the equivalents thereof

What is claimed is:

1. A shroud assembly for headgear, comprising:

a frame having a first side configured to face toward an exterior surface of the headgear and a second side opposite the first side and configured to face away from the headgear, the first side having a shape that is configured to match a contour of the headgear, the frame having a central opening defining a peripheral edge;

a first insert separately formed from the frame and removably attached to the first side of the frame, the first insert comprising a generally rectangular body having four sides and four corners, wherein each of the four corners are attached directly to the first side of the frame, the first insert configured for removable attachment to a mounting assembly; and the frame including first and second spaced apart walls disposed on the second side of the frame on opposite sides of the first insert, said first and second walls spaced a distance apart to provide an interference fit between the mounting assembly and the first and second spaced apart walls, wherein each of the four corners of the first insert have a fastening portion extending outward from the generally rectangular body, each fastening portion being configured to overlap the peripheral edge of the central opening on the first side of the frame and receive a threaded fastener which is configured to threadably engage a corresponding aligned threaded opening formed on the first side of the frame.

2. The shroud assembly of claim 1, further comprising:

the first insert comprising a central area received in said central opening; and one or more fasteners coupling the one or more fastening portions to the first side of the frame adjacent the peripheral edge.

3. The shroud assembly of claim 1, wherein the frame is formed of a material selected from the group consisting of a polymer material, an injection moldable thermoplastic resin, and a fiber reinforced polymer matrix composite material.

4. The shroud assembly of claim 1, wherein the frame is formed of a glass fiber reinforced polyimide matrix composite material.

5. The shroud assembly of claim 1, wherein the first insert is formed of a metal or metal alloy.

6. The shroud assembly of claim 1, wherein the first and second spaced apart walls extend vertically on opposite lateral sides of the first insert.

7. The shroud assembly of claim 1, wherein the first and second spaced apart walls are flexible.

8. The shroud assembly of claim 1, wherein the first and second spaced apart walls are configured to be displaced outward when the mounting assembly is removably attached to the first insert.

9. The shroud assembly of claim 1, wherein each of the first and second spaced apart walls have a tapered inward facing surface to facilitate insertion of the mounting system.

10. The shroud assembly of claim 1, further comprising one or both of:

said first insert defining one or more receptacles configured to removably mate with a latch member of the mounting assembly; and at least one opening in the frame configured to receive a mechanical fastener for attaching the shroud assembly to the headgear.

11. The shroud assembly of claim 1, further comprising:

first, second, and third openings in the frame, each of the first, second, and third openings configured to receive a mechanical fastener for attaching the shroud assembly to the headgear.

12. The shroud assembly of claim 11, wherein the first, second, and third openings are positioned in a pattern which corresponds to a three-hole drill hole pattern on a helmet.

13. The shroud assembly of claim 1, further comprising:

a friction pad removably attached to the second side of the frame for increasing friction between the shroud assembly and the helmet, wherein the first insert is disposed intermediate the frame and the friction pad.

14. The shroud assembly of claim 13, further comprising:

at least one boss protruding from the friction pad and configured to extend through a complementary opening in the frame.

15. The shroud assembly of claim 13, further comprising a first opening in the first insert, a second opening in the frame, and a third opening in the friction pad, wherein the first, second, and third openings are aligned with an opening in the helmet for receiving a mechanical fastener for attaching the shroud assembly to the helmet.

16. The shroud assembly of claim 15, wherein the position of the first opening corresponds to a single drill hole pattern.

17. The shroud assembly of claim 15, further comprising:

fourth, fifth, and sixth openings in the frame;

seventh, eighth, and ninth openings in the friction pad, the seventh, eight, and ninth openings aligned with the fourth, fifth, and sixth openings, respectively; and a removable plug received in each of the seventh, eighth, and ninth openings.

18. The shroud assembly of claim 17, wherein each plug has a protrusion configured to extend into a respective one of the fourth, fifth, and sixth openings in the frame.

19. The shroud assembly of claim 17, wherein the fourth, fifth, and sixth openings in the frame are positioned in a pattern which corresponds to a three-hole drill hole pattern on a helmet.

20. The shroud assembly of claim 1, further comprising the mounting assembly removably attached to the first insert, wherein the mounting assembly is a night vision device mounting assembly.

21. The shroud assembly of claim 1, further comprising a second insert interchangeably attachable to the frame in place of the first insert.

22. A helmet assembly comprising:

a helmet having an exterior surface, the helmet including one or more holes, a left side portion, a right side portion, and a front portion extending between the left side portion and the right side portion;

a shroud assembly including a frame removably attached to the front portion of the helmet and having a first side configured to face toward the exterior surface of the helmet and a second side opposite the first side and configured to face away from the helmet, the first side having an interior curve shape that matches an exterior curve shape of the helmet, the frame having a central opening defining a peripheral edge;

the shroud assembly further including an insert separately formed from the frame and removably attached to the first side of the frame, the first insert comprising a generally rectangular body having four sides and four corners, wherein each of the four corners are attached directly to the first side of the frame, the insert configured for removable attachment to a mounting assembly for a night vision device; and the frame including first and second spaced apart walls disposed on the front side of the frame on opposite sides of the insert, said first and second walls spaced a distance apart to provide an interference fit between the mounting assembly and the first and second spaced apart walls, wherein each of the four corners of the first insert have a fastening portion extending outward from the generally rectangular body, each fastening portion being configured to overlap the peripheral edge of the central opening on the first side of the frame and receive a threaded fastener which is configured to threadably engage a corresponding aligned threaded opening formed on the first side of the frame.

23. The helmet assembly of claim 22, wherein the shroud assembly is removably attached to the helmet by one or more fasteners, each of said one or more fasteners extending through a corresponding aligned hole in the helmet and a corresponding aligned hole in the shroud assembly.

24. The helmet assembly of claim 22, wherein the shroud assembly is removably attached to the helmet by fasteners extending through an aligned hole in the helmet and an aligned hole in the insert.

25. The helmet assembly of claim 24, further comprising a friction pad disposed between the helmet and the shroud assembly.

26. The helmet assembly of claim 22, wherein the shroud assembly is removably attached to the helmet by three fasteners, each fastener extending through a corresponding aligned hole in the helmet and a corresponding aligned hole in the frame.

27. A method for attaching a mounting assembly to a helmet, comprising:

providing a shroud assembly by removably attaching an insert to a first side of a frame, the frame having a central opening defining a peripheral edge, the insert separately formed from the frame and removably attached to the first side of the frame, the insert comprising a generally rectangular body having four sides and four corners, wherein each of the four corners are attached directly to the first side of the frame, the insert configured for removable attachment to the mounting assembly, the frame having a second side opposite the first side, the first side configured to face toward an exterior surface of the helmet and the second side configured to face away from the helmet, the first side having a shape that matches a contour of the helmet; and the frame including first and second spaced apart walls disposed on the front side of the frame on opposite sides of the insert, said first and second walls spaced a sufficient distance apart to provide an interference fit between the mounting assembly and the first and second spaced apart walls, wherein each of the four corners of the first insert have a fastening portion extending outward from the generally rectangular body, each fastening portion being configured to overlap the peripheral edge of the central opening on the first side of the frame and receive a threaded fastener which is configured to threadably engage a corresponding aligned threaded opening formed on the first side of the frame.

28. The method of claim 27, wherein the shroud assembly further includes a friction pad removably attached to the second side of the frame for increasing friction between the shroud assembly and the helmet, wherein the insert is disposed intermediate the frame and the friction pad.

29. The method of claim 27, further comprising:

removably attaching a night vision device to the mounting assembly.

* * * * *